United States Patent [19]

Narozny

[11] 4,043,628

[45] Aug. 23, 1977

[54] ELECTRICAL CONTACT

[75] Inventor: Ronald S. Narozny, Panorama City, Calif.

[73] Assignee: Thomas & Betts Corporation, Elizabeth, N.J.

[21] Appl. No.: 697,625

[22] Filed: June 18, 1976

[51] Int. Cl.[2] ..... H01R 13/38

[52] U.S. Cl. ..... 339/99 R

[58] Field of Search ..... 339/97–99

[56] References Cited

U.S. PATENT DOCUMENTS

| | | | |
|---|---|---|---|
| 3,403,372 | 9/1968 | Stinson, Jr. | 339/97 R |
| 3,964,816 | 6/1976 | Narozny | 339/99 R |

FOREIGN PATENT DOCUMENTS

| | | | |
|---|---|---|---|
| 479,961 | 11/1969 | Switzerland | 339/97 R |

*Primary Examiner*—Joseph H. McGlynn

*Attorney, Agent, or Firm*—David Teschner; Jesse Woldman

[57] ABSTRACT

An electrical contact for use preferably in connection with ribbon-type flat cable comprises a rectangularly configured head portion having discrete, individually sloped cutting edges at the upper end thereof for piercing through the webbed insulation between adjacent conductors of the cable, the front and rear walls of the head portion being suitably slotted to receive a conductor and make electrical contact therewith.

16 Claims, 14 Drawing Figures

ELECTRICAL CONTACT

BACKGROUND OF THE INVENTION

1. Field of the Invention

The invention is directed to the field of electrical contacts for electrically and mechanically coupling to the conductive portion of an insulated conductor.

2. Description of the Prior Art

In the field of connecting devices for ribbon or flat cable which is generally manufactured as a series of spaced, parallel conductive elements imbedded within a flexible sheet of electrically insulative material, various forms of connecting devices commonly referred to as flat cable connectors have been designed to be coupled to the cable to provide electrical continuity between the conductors of the cable and a further electrical part or device. Such connectors generally include a series of aligned electrical contacts spaced in such manner as to coincide with the individual conductors of the cable for engagement therewith. Although relatively slow, inconvenient, and time consuming, solder and welding techniques are employed in some cases for joining the contact to a respective conductor, other connecting devices have been designed which provide a more rapid, convenient, and more reliable connection by employing specially configured contacts arranged to pierce or sever the insulation surrounding a conductor and electrically engage the resulting bared portion of the conductor. One such prior art contact is disclosed in pending Application Ser. No. 499,588, now U.S. Pat. No. 3,964,816, of Ronald Narozny, applicant herein, and assigned to the assignee of the instant invention, the contact including an insulation piercing head portion having a generally circular configuration, in transverse section. Two diametrically opposed longitudinal slots are provided to receive a conductor therewithin as the cable is forced downwardly against the top rim of the head portion. The circular configuration has been used extensively with flat cable having an approximate conductor spacing of 0.050 inches on centers to provide a secure, rapid, and reliable connection thereto. Recently, however, increased density flat cable having an approximate conductor spacing of 0.025 inches on centers, or one half of the above spacing, has been developed for applications requiring greater miniaturization. The need for maintaining a certain minimum spacing between a particular contact and an adjacent conductor required a substantial reduction in the size of contact employed with such increased density cable. It was found that, due to present manufacturing limitations the maximum practical reduction of the diameter of the circular configuration contact was insufficient to meet the above noted requirements, thereby creating a need for a differently configured contact which would provide the necessary reliability, convenience, and economy of manufacture while meeting the space requirements referred to above.

SUMMARY OF THE INVENTION

The invention overcomes the limitations and difficulties noted above with respect to prior art devices by providing an insulation piercing electrical contact having a rectangularly configured head portion, in transverse section, and which may be readily manufactured in a sufficiently reduced size to permit its use with flat cable of increased conductor density, but which may also be readily manufactured in larger sizes for use with the common low and medium conductor density flat cable having, for example, a conductor spacing of 0.050 inches and 0.100 inches on centers. The insulation piercing function is accomplished by the provision of a series of cutting edges which may be sloped and beveled relative to a plane normal to the central longitudinal axis of the head portion, and which form the upper terminating ends of the front, rear, and side walls thereof. The front and rear walls are further provided with longitudinally extending opposed slots adapted to engagingly receive a conductor disposed thereacross. One slot extends the length of a respective wall to provide an open seam thereat permitting elastic deflection of the adjacent walls upon the insertion of a conductor therebetween. The remaining slot extends only partially down the length of its respective wall and provides a fixedly spaced opening preferably smaller than the transverse dimension of the conductor to be received therewithin. A series of such contacts may be assembled in selectively spaced arrangement within an electrically insulative housing to provide a reliable, inexpensive, and readily manufactured flat cable connector adaptable to low, medium, and high density flat cable. A tail portion extending from the head portion of the contact may be suitably configured to provide for a solder, weld, pressure, or wire wrap connection to a further conductive element, or shaped to provide a socket or pin termination for mating engagement with a further element. It is therefore an object of this invention to provide a novel electrical contact preferably for engaging an individual conductor of a flat cable.

It is another object of this invention to provide an electrical contact adaptable for use with relatively high conductor density flat cable.

It is a further object of this invention to provide a miniaturized insulation piercing electrical contact.

It is yet another object of this invention to provide a strong, reliable, efficient, and inexpensive insulation piercing electrical contact preferably for use with flat cable.

It is still another object of this invention to provide an insulation piercing electrical contact for assembly in a miniaturized electrical connector for flat cable.

It is yet a further object of this invention to provide an electrical contact designed for close spacing in an assembled array to provide an efficient and reliable miniaturized flat cable connector.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 1:
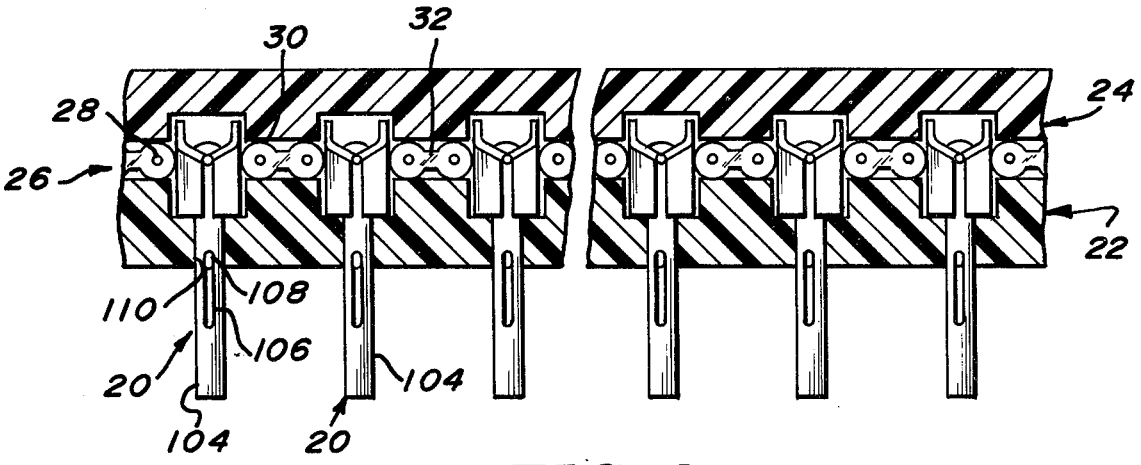
FIG. 1 is a fragmentary front elevational view, partly in section, showing a portion of a connector having a series of electrical contacts constructed in accordance with the concepts of the invention.
Figure 2:
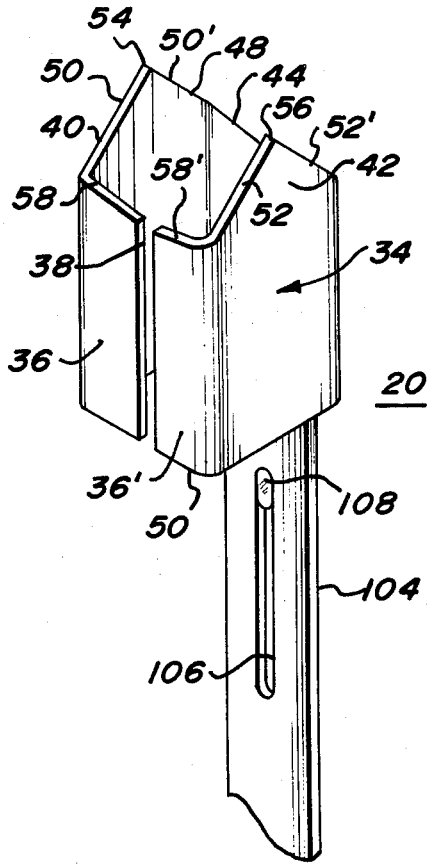
FIG. 2 is a fragmentary front perspective view showing further details of an electrical contact constructed in accordance with the concepts of the invention.
Figure 3:
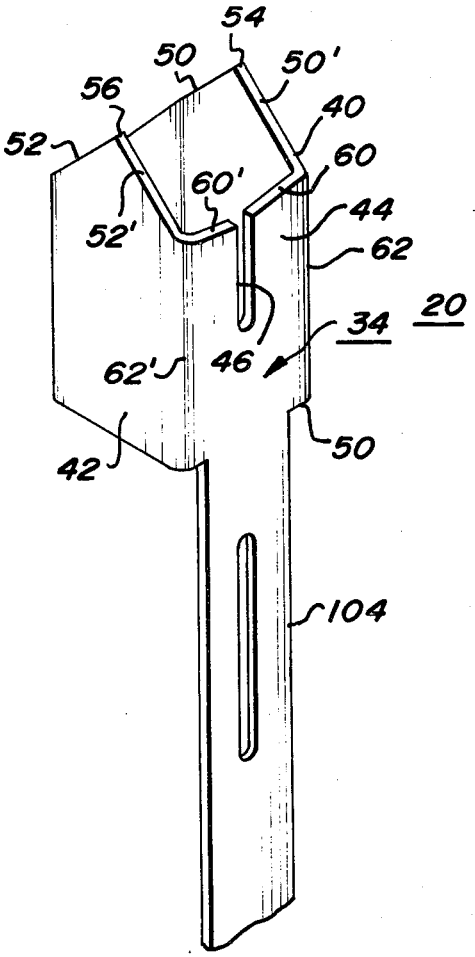
FIG. 3 is a fragmentary rear perspective view showing additional details of the contact of FIG. 2.
Figure 4:
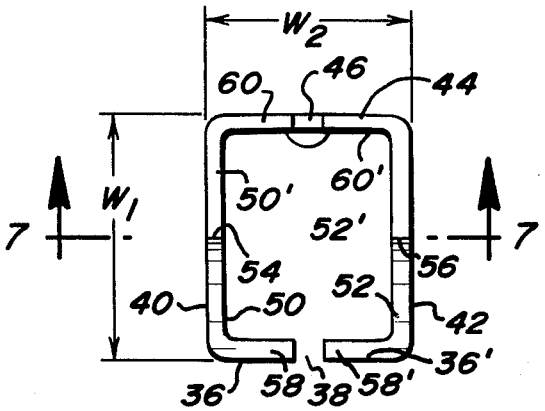
FIG. 4 is a top plan view of the contact of FIG. 2.
Figure 5:
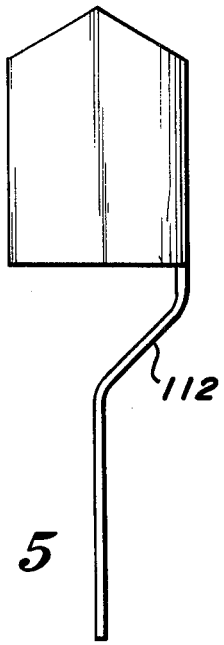
FIG. 5 is a side elevational view of a further embodiment of an electrical contact constructed in accordance with the concepts of the invention.
Figure 6:
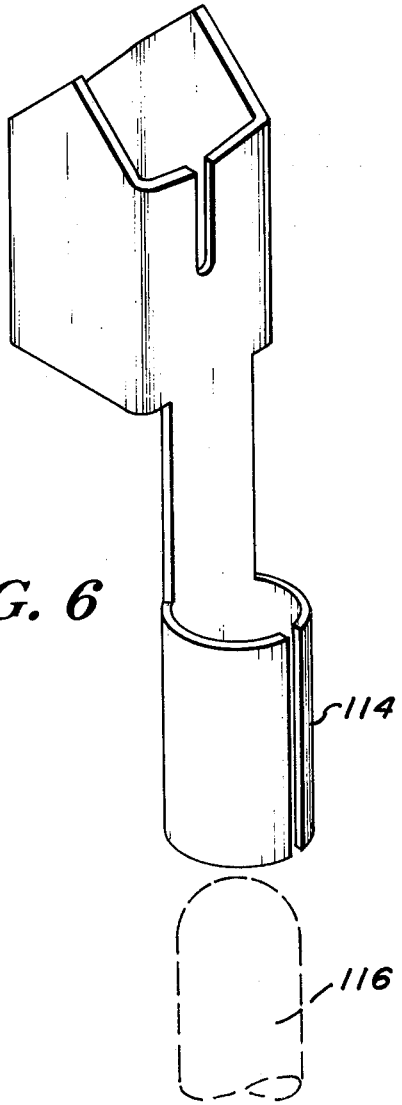
FIG. 6 is a rear perspective view of a further embodiment of an electrical contact constructed in accordance with the concepts of the invention.
Figure 7:
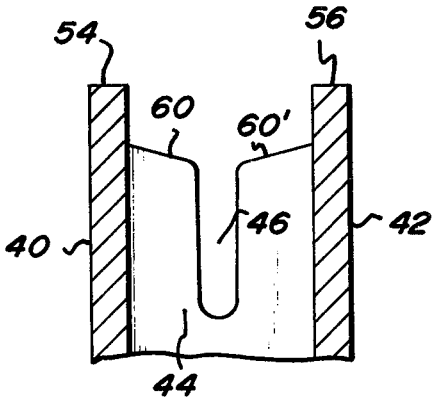
FIG. 7 is a fragmentary sectional view taken along the line 7—7 of FIG. 4.
Figure 8:
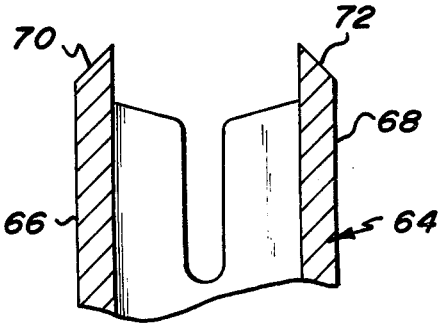
FIGS. 8, 9, and 10 are fragmentary sectional views showing further embodiments of the cutting edges of an electrical contact constructed in accordance with the concepts of the invention.
Figure 9:
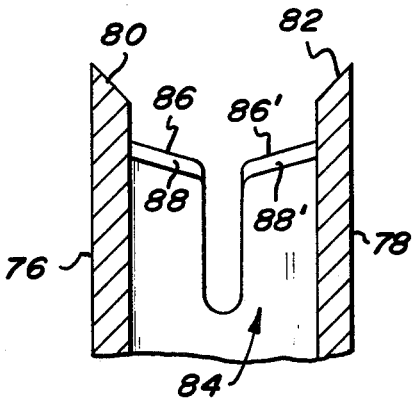
Figure 10:
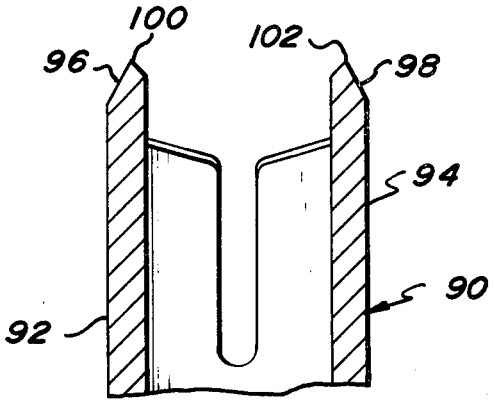

Turning now to FIGS. 1, 2, 3, 4, and 7 there is shown an electrical contact 20 constructed in accordance with the concepts of the invention. In FIG. 1 each of the contacts 20 is shown as assembled within an electrically insulative housing 22 over which is disposed a cover portion 24. Sandwiched between the housing 22 and the cover portion 24 is a section of flat cable 26 containing a array of spaced parallel conductors 28 embedded within a sheet of flexible insulative material 30, each of the conductors 28 being totally surrounded by the insulative material 30 and insulated from one another by a web portion 32 which, although shown as a section of reduced thickness, may have a thickness equivalent to that of the remainder of the cable 26 thus providing relatively smooth upper and lower surfaces rather than the undulating configuration shown, the contacts 20 being designed to function equally as well with either cable configuration. The contact 20 comprises a head portion 34 (FIG. 2) having a front wall divided into two discrete front wall portions 36 and 36′ by a first slot 38, a pair of spaced opposing side walls 40 and 42, and a rear wall 44. Extending partially down the length of the rear wall 44 is a second slot 46 (FIG. 3). The configuration of the head portion 34 is preferably substantially rectangular, in transverse section, wherein, as may be seen more clearly in FIG. 4, the side walls 40 and 42 are of equal width $W_1$ and comprise the long dimension of the rectangle, and the rear wall 44 and the opposing front wall portions 36 and 36′ are of equal overall width $W_2$ and comprise the short dimension of the rectangle. The dimension $W_1$ and $W_2$ may, of course, be equal to one another, where necessary or desirable, to provide a substantially square configuration. The head portion 20 includes an upper end 48 and a lower end 50, the upper end 48 comprising a series of cutting edges defined by the upper terminating ends of each of the walls of the head portion 20. For example, the sidewalls 40 and 42 each terminates in two cutting edges 50, 50′ and 52, 52′ respectively, sloping downwardly to either side of a respective crest 54, 56. The front wall portions 36 and 36′ each terminates in a respective cutting edge 58, 58′ which slopes downwardly towards the slot 38 from the juncture between a front wall portion 36, 36′ and a corresponding respective side wall 40, 42. In a similar manner the rear wall 44 terminates in two cutting edges 60, 60′ (FIG. 3) each of which slopes downwardly towards the slot 46 from the juncture between a side edge 62, 62′ of the rear wall 44 and a corresponding respective side wall 40, 42. It should also be appreciated that the side edges defining each of the slots 38 and 46 provide further edges which may be employed either as pressure or cutting edges, where necessary or desirable. The side wall crests 54 and 56, although located preferably along the central longitudinal axis of a respective side wall 40, 42 to provide a symmetrical side wall contour adjacent the upper end of the head portion 34, may be displaced to either side of the central longitudinal axis of a respective side wall so that the side wall forwardly disposed cutting edges 50 and 52 may be either longer or shorter than the rearwardly disposed side wall cutting edges 50′ and 52′. Since the contact 20 may be fabricated from relatively thin electrically conductive flat metallic stock which, for example, may be in the order of from three thousandths to fifteen thousandths of an inch, the cutting edges 50, 50′, 52, 52′, 58, 58′ and 60, 60′ may comprise unbeveled surfaces planarly oriented substantially normal to the plane of the respective side, front, and rear walls, respectively, while serving to provide a sufficiently narrow edge to adequately pierce or sever the insulation of the flat cable at the desired locations. However, where additional sharpness is either necessary or desirable, either some or all of the cutting edges may be suitably beveled as shown, for example, in FIGS. 8, 9, and 10. In FIG. 8 there is shown a segment of a head portion 64 having sidewalls 66 and 68 terminating at their upper ends in cutting edges 70 and 72, respectively, which are beveled downwardly from the interior of the head portion 64 towards the outer surfaces of the side walls 66 and 68, respectively. It should be understood that each of the respective cutting edges at the upper terminating ends of the remainder of the walls enclosing the head portion 64 may be similarly beveled. In FIG. 9 there is shown a segment of a head portion 74 having sidewalls 76 and 78 terminating at their upper ends in cutting edges 80 and 82, respectively, which are beveled downwardly from the exterior of the head portion 74 towards the interior surfaces of the respective side walls 76 and 78. Thus, the only substantial difference between the embodiments illustrated in FIGS. 8 and 9, and that shown in FIG. 2 is the degree of sharpness of the respective cutting edges. As noted above with respect to the embodiment illustrated in FIG. 8, the beveled cutting edge arrangement shown in FIG. 9 may be limited merely to the cutting edges of the side walls of the head portion 74, or may be provided on either one or more of the remaining head portion walls. For example, as further illustrated in FIG. 9, the head portion 74 includes a rear wall 84 having cutting edges 86 and 86′ which are inwardly beveled, as at 88 and 88′, in a manner similar to that indicated at 80 and 82. A combination of the arrangements shown in FIGS. 8 and 9 may be employed in a manner shown, for example, in the embodiment illustrated in FIG. 10 wherein there is shown a segment of a head portion 90 having sidewalls 92 and 94, each terminating at its respective upper end in a cutting edge 96, 98, beveled to either side of a sharpened ridge 100, 102, respectively. Here again, the remaining cutting edges of the head portion 94 may be similarly configured, where necessary or desirable. Returning now to FIGS. 1, 2, and 3, the sidewalls 40 and 42 are preferably of similar shape and height and extend above the upper terminating ends of the adjacent front wall portions 36 and 36', and rear wall 44. Thus, as the upper end of the head portion 34 of the contact 20 is brought into initial engagement with the flat cable 26, the pointed side wall crests 54 and 56 will initially pierce the insulation 30 of the cable 26 so that the cutting edges 50, 50' and 52, 52' may enter the insulation 30 and expand the initially pierced area to provide an elongate slit thereat. The perpendicularly disposed cutting edges 58 and 58', and 60 and 60' associated with the respective front wall portions 36 and 36', and the rear wall 44, serve to sever the insulation directly adjacent a respective conductor 28 preparatory to the conductor 28 being forced into the slots 38 and 46. Accordingly, the contact 20 electrically engages the conductor 28 through a series of preparatory operations in which the cable 26 is pierced, severed, and suitably parted to provide access to the contained conductor 28. It will also be appreciated that the box-like construction of the head portion 34 provides an inherent rigidity necessary to prevent deformation of the wall portions thereof and to insure effective electrical engagement with the conductor 28. As further illustrated, the contact 20 includes a tail portion 104, which, for the sake of convenience, is shown as extending from the lower end of the rear wall 44 of the head portion 34, but which may extend from the lower end of any other desired wall of the head portion 34. For the sake of manufacturing convenience, the tail portion 104 is shown as integral with the remainder of the contact 20 so that the entire contact 20 may be inexpensively fabricated from a single blank of flat stock. An elongate raised portion 106 (FIG. 2) is provided along a length of the tail portion 104, the upper end of the portion 106 having an accentuated dome-like protrusion 108 which may be employed for frictionally locking the contact 20 within a suitably configured orifice 110 (FIG. 1) in the housing 22. The tail portion 104 provides a means for attaching the contact 20 to a further electrical element or device and may be suitably configured in a variety of shapes and forms in accordance with the method of connection employed. For example, the linear shape shown in FIGS. 1, 2, and 3 may be employed to provide a tab extension for mating engagement with a receiving socket in a mating connector or other electrical device such as a printed circuit board or the like, (not shown) or may be utilized as a solder or wire-wrap post for connection to an electrical conductor (not shown). Furthermore, the tail portion 104 may be provided with one or more offset segments such as shown at 112 in FIG. 5 to conform to a particular tail portion receiving aperture in a housing such as 22. Alternatively, the tail portion 104 may be provided with a hollow tubular section such as shown at 114 in FIG. 6 which may serve as a socket for receiving a pin means shown by the dotted outline 116 in FIG. 6. Conversely, the tubular section 114 may be suitably configured to provide a pin-like element for insertion into a mating socket (not shown).

Figure 11:
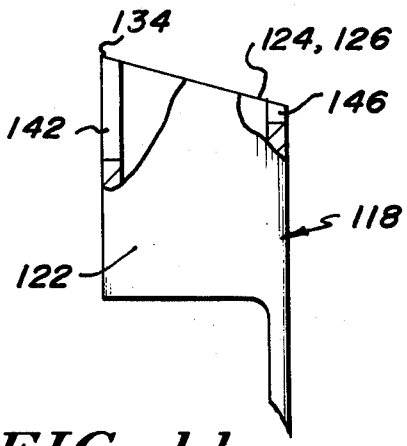
FIG. 11 is a fragmentary side elevational view, partly cut away, showing a further embodiment of an electrical contact constructed in accordance with the concepts of the invention.
Figure 12:
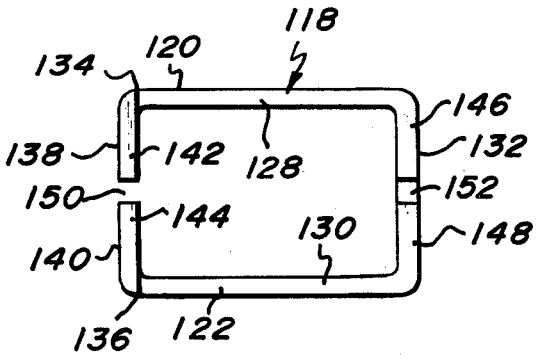
FIG. 12 is a top plan view of the contact of FIG. 11.
Figure 13:
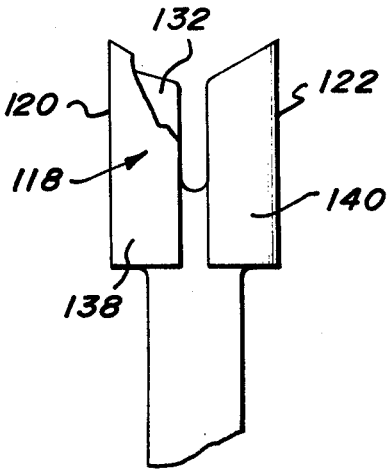
FIG. 13 is a fragmentary front elevational view, partly cut away, of the contact of FIG. 11.

Turning now to FIGS. 11, 12, and 13 there is shown a further embodiment of a head portion 118 of an electrical contact constructed in accordance with the concepts of the invention and similar to the head portion 34. In this case, however, the head portion 118 comprises a pair of opposing side walls 120 and 122 each having a truncated upper end 124, 126, respectively, terminating in respective curring edges 128 and 130 (FIG. 12), each being inclined downwardly and rearwardly towards a rear wall 132 from a forwardly disposed crest 134, 136, respectively, the crests 134 and 136 each being located at the juncture between its associated side wall 120 and 122 and a respective front wall portion 138 and 140, the walls 132, 138, and 140 being essentially similar to the respective elements 44, 36, and 36' described above. The front wall portions 138 and 140 also include, at their upper terminating ends, inclined cutting edges 142 and 144 similar to edges 58 and 58', while the rear wall 132 includes, at its upper terminating end, cutting edges 146 and 148 similar to edges 60 and 60'. It should be noted that in the case of the head portion 118 the crests 134 and 136 function in a manner similar to crests 54 and 56 described above with respect to the embodiment illustrated in FIGS. 1, 2, and 3. The head portion 118 is also similarly provided with a first or front slot 150 essentially duplicative of slot 38, and a second or rear slot 152 essentially duplicative of slot 46, each of the slots 150 and 152 lying along a common axis bisecting the width of the head portion 118 between the side walls 120 and 122 in a manner similar to the disposition of slots 38 and 46. It should also be appreciated that the front wall portion 138 and 140, although shown as planarly disposed preferably at essentially a 90° angle with respect to the planes of the respective side walls 120 and 122, may be bent outwardly or inwardly slightly from the preferred position to form either an obtuse or acute angle with their respective side walls, without departing from the spirit of the invention and within the concepts herein disclosed. A similar modification may, of course, be employed with respect to the front wall portions 36 and 36' of the head portion 34. In any case, it is intended that a generally rectangular box-like configuration is still maintained despite slight variation in the actual angle at which the planes of the respective walls of the head portions 34 and 118 intersect one another.

Figure 14:
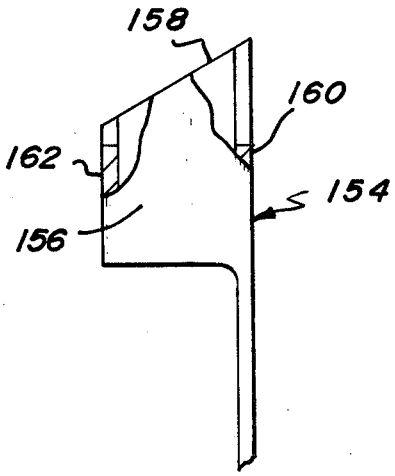
FIG. 14 is a fragmentary side elevational view, partly cut away, of a further embodiment of an electrical contact constructed in accordance with the concepts of the invention.

Referring now to FIG. 14 there is shown a further embodiment of a head portion 154 of an electrical contact constructed in accordance with the concepts of the invention, the head portion 154 being similar to head portion 118 in that the sidewalls thereof, only one of which is visible in FIG. 14 and is designated 156, are provided with a truncated upper end 158 inclined downwardly and forwardly from a rear wall 160 to a front wall 162 which is divided into front wall portions (not visible) similar to elements 138 and 140 (FIG. 13). In this case, however, it should be noted that the front wall portions defining the front wall 162 are shorter than the rear wall 160 whereas, in the embodiment shown in FIGS. 11 through 13, the rear wall 132 is shorter than the front wall portions 138 and 140. In each case, however, the sidewalls are substantially symmetrical and of equal length to insure substantially simultaneous penetration of the cable insulation 30 on either side of the conductor 28.

I claim:

1. An electrical contact comprising: a head portion having a generally rectangular configuration in transverse section and having an upper end and a lower end; and a tail portion integral with and extending from said lower end of said head portion; said head portion being defined by a front wall, a rear wall, and a pair of spaced, opposing sidewalls, there being an elongate first slot extending along the length of and separating said front wall into two front wall portions, there being an elongate second slot extending a given distance along the length of said rear wall from said head portion upper end towards said head portion lower end, said front wall portions, said rear wall, and said sidewalls each terminating at a respective cutting edge adjacent said upper end of said head portion for piercing the insulation about an insulated conductor, the sides of said first and said second slots comprising additional cutting edges, at least one of said additional cutting edges being arranged to sever the insulation about an insulated conductor and engage such conductor, said rear wall having spaced side edges, each of said front wall portions and a respective sidewall connected thereto being hingedly joined to a respective side edge of said rear wall for cantilevered outward deflection of said sidewalls about a respective rear wall side edge upon the receipt of a conductor within said first slot.

2. An electrical contact as defined in claim 1 wherein each of said sidewalls terminates in a crest adjacent said head portion, said cutting edges of a respective sidewall being axially inclined downwardly respectively from said crest towards said front wall and said rear wall.

3. An electrical contact as defined in claim 1 wherein each of said front wall portion cutting edges is axially inclined downwardly from the juncture between a respective front wall portion and its respective sidewall towards said first slot.

4. An electrical contact as defined in claim 1 wherein said second slot divides said rear wall cutting edge into two cutting edge portions, each of said rear wall cutting edge portions being axially inclined downwardly from a respective rear wall side edge towards said second slot.

5. An electrical contact as defined in claim 1 wherein each of said side wall cutting edges comprises a beveled surface sloping downwardly from the interior surface of said sidewall towards the exterior surface of said sidewall.

6. An electrical contact as defined in claim 1 wherein each of said side wall cutting edges comprises a beveled surface sloping downwardly from the exterior surface of said sidewall towards the interior surface of said sidewall.

7. An electrical contact as defined in claim 1 wherein said sidewalls comprise the long dimension of said head portion rectangular configuration and said front and said rear walls comprise the short dimension of said head portion rectangular configuration.

8. An electrical contact as defined in claim 1 wherein the height of said front wall is essentially equal to the height of said rear wall.

9. An electrical contact as defined in claim 1 wherein the height of said front wall is greater than the height of said rear wall.

10. An electrical contact as defined in claim 1 wherein the height of said front wall is less than the height of said rear wall.

11. An electrical contact as defined in claim 1 wherein the said sidewalls have a maximum height at least equal to the height of said front wall.

12. An electrical contact as defined in claim 1 wherein said sidewalls have a maximum height at least equal to the height of said rear wall.

13. An electrical contact as defined in claim 1 wherein said sidewalls have a maximum height greater than the height of said front wall.

14. An electrical contact as defined in claim 1 wherein said sidewalls have a maximum height greater than the height of said rear wall.

15. An electrical contact as defined in claim 1 wherein each of said sidewalls terminates in a sharpened crest located adjacent said upper end of said head portion and generally equidistant from the side edges of said sidewall.

16. An electrical contact as defined in claim 15 wherein said cutting edges of a respective sidewall are axially inclined downwardly respectively from said crest towards said front wall and said rear wall.

* * * * *

UNITED STATES PATENT AND TRADEMARK OFFICE

CERTIFICATE OF CORRECTION

PATENT NO. : 4,043,628
DATED : August 23, 1977
INVENTOR(S) : Ronald S. Narozny

It is certified that error appears in the above-identified patent and that said Letters Patent are hereby corrected as shown below:

Column 5, line 67, "curring" should be -- cutting --

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*